US007440283B1

(12) United States Patent
Rafie

(10) Patent No.: US 7,440,283 B1
(45) Date of Patent: Oct. 21, 2008

(54) THERMAL ISOLATION DEVICES AND METHODS FOR HEAT SENSITIVE DOWNHOLE COMPONENTS

(75) Inventor: Saeed Rafie, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/777,679

(22) Filed: Jul. 13, 2007

(51) Int. Cl.
*H05K 7/20* (2006.01)
*E21B 36/00* (2006.01)

(52) U.S. Cl. ..... 361/709; 361/704; 165/185; 166/57; 166/302

(58) Field of Classification Search ..... 361/704, 361/709–710; 165/185; 166/57, 302
See application file for complete search history.

(56) References Cited

U.S. PATENT DOCUMENTS

| | | | | |
|---|---|---|---|---|
| 2,521,294 | A * | 9/1950 | Jackson | 62/168 |
| 3,859,523 | A * | 1/1975 | Wilson et al. | 250/261 |
| 5,647,429 | A * | 7/1997 | Oktay et al. | 165/104.26 |
| 6,336,408 | B1 * | 1/2002 | Parrott et al. | 102/312 |
| 6,638,444 | B2 * | 10/2003 | Hayes | 252/70 |
| 2005/0097911 | A1 * | 5/2005 | Revellat et al. | 62/259.2 |
| 2006/0102353 | A1 * | 5/2006 | Storm et al. | 166/302 |
| 2006/0191682 | A1 * | 8/2006 | Storm et al. | 166/250.01 |
| 2006/0213660 | A1 * | 9/2006 | DiFoggio et al. | 166/254.2 |
| 2007/0095543 | A1 * | 5/2007 | Tchakarov et al. | 166/380 |

OTHER PUBLICATIONS

Proceedings of 2nd Energy Nanotechnology International Conference; ENIC 2007; Sep. 5-7, 2007, Santa Clara, CA; ENIC2007-45007; Thermal Management of Downhole Oil & Gas Logging Sensors for HTHP Applications Using Nanoporous Materials; Saeed Rafie; Baker Hughes- INTEQ; Houston, Texas USA; Copyright 2007 by ASME.

* cited by examiner

*Primary Examiner*—Jayprakash N Gandhi
*Assistant Examiner*—Robert J Hoffberg
(74) *Attorney, Agent, or Firm*—Madan Mossman & Sriram

(57) ABSTRACT

A device for isolating a heat sensitive component includes a heat sink positioned adjacent to the heat sensitive component. The heat sink has a stepped thermal response to an applied heat. The heat sink may include two or more thermally decoupled masses. Thermal decoupling may be achieved by positioning a nanoporous material positioned between the two masses. The heat sensitive component and the heat sink may be positioned inside a container such as a Dewar-like flask and connected to the container with a connector. The connector may function as a thermal isolator that impedes the flow of heat into the interior of the container. In one embodiment, the connector includes at least one bridge portion having a reduced cross-sectional area and/or a longitudinally elongated opening to impede heat flow. Nanoporous material may be positioned in the container at locations that assist in thermally isolating the heat sink and heat sensitive components.

18 Claims, 5 Drawing Sheets

THERMAL ISOLATION DEVICES AND METHODS FOR HEAT SENSITIVE DOWNHOLE COMPONENTS

BACKGROUND OF THE DISCLOSURE

1. Field of the Invention

The disclosure relates to protecting and/or isolating heat sensitive components used in downhole applications.

2. Description of the Prior Art

Oil and gas are generally recovered from subterranean geological formations by means of oil wells. For the purposes of this disclosure, an oil well is a hole drilled through the Earth above such geological formations. Typically, the well is drilled to and more often through an oil producing formation. This hole is commonly referred to as a wellbore or bore hole of the oil well and any point within the wellbore is generally referred to as being downhole.

Wellbore temperatures can vary from ambient up to about 500° F. (260° C.) and pressures from atmospheric up to about 30,000 psi (206.8 mega pascals). Temperature and pressure conditions such as these can have an adverse effect on instruments used downhole. Heat especially can be undesirable for tools having electronic components. For example, wireline and/or Measurement While Drilling (MWD) logging tools for measuring certain formation characteristics and wellbore properties often use heat-sensitive electronic gauges and sensors. Elevated temperatures can restrict the amount of time that these wireline logging tools may be operated inside the wellbore, i.e., the temperature survival time. Generally speaking, exposure to excess heat can cause electronic components to work improperly or even fail.

Thus, there is a need for thermal isolation devices and methods that isolate downhole devices from the relatively high temperatures associated with subterranean wellbores and/or heat generated by downhole components.

SUMMARY OF THE DISCLOSURE

In aspects, the present disclosure provides devices for isolating one or more heat sensitive components deployed in a downhole environment. In one arrangement, the device includes a heat sink positioned adjacent to a heat sensitive component. The heat sink is configured to have a stepped thermal response to an applied heat. In one embodiment, the heat sink includes two masses that are substantially thermally decoupled. The thermal decoupling may be achieved by positioning a nanoporous material between the two masses. The heat sink may also have more than two masses so arranged. The heat sensitive component and the heat sink may be positioned in an interior of a container that is configured to be deployed into a wellbore with a conveyance device. The container may be a Dewar-like flask. A connector may be used to connect the heat sink to the container. The connector operates as a thermal isolator that impedes the flow of heat into the interior of the container. The connector may be formed of stainless steel, titanium or other material having a low thermal conductivity. In one embodiment, the connector includes at least one bridge portion having a reduced cross-sectional area that impedes the flow of heat. In some arrangements, the connector may include one or more elongated openings aligned along a longitudinal axis of the connector. These openings also reduce the cross-sectional area through which heat can flow. In certain embodiments, a nanoporous material may be positioned in the container at locations that assist in thermally isolating the heat sink or other components from a heat applied by the downhole environment.

In aspects, one method provided by the present disclosure includes conveying a downhole tool into a wellbore using a conveyance device such as a wireline, a slickline, a coiled tubing, or drill pipe. To thermally isolate heat sensitive components associated with the downhole tool, the heat sensitive components may be positioned in the interior of a container coupled to the conveyance device. The heat sensitive components may be used in connection with downhole processing devices, sensors, transmitters, memory devices, communication devices, electronic devices, etc. During deployment downhole, the container provides one thermal barrier for these heat sensitive components. A connector connects the components inside the container to the container. The low thermal conductivity of the connector along with reduced cross-sectional areas also forms a thermal barrier against heat applied by the downhole environment. Within the container, a heat sink positioned adjacent to the heat sensitive component absorbs heat that does enter the container interior that would otherwise detrimentally affect the heat sensitive components. As described earlier, the heat sink may be configured to have a stepped thermal response to an applied heat and may absorb heat applied by the downhole environment as well as heat generated by components inside the container.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

The disclosure is best understood with reference to the accompanying figures in which like numerals refer to like elements, and in which.

DESCRIPTION OF THE EMBODIMENTS OF THE DISCLOSURE

Figure 1:
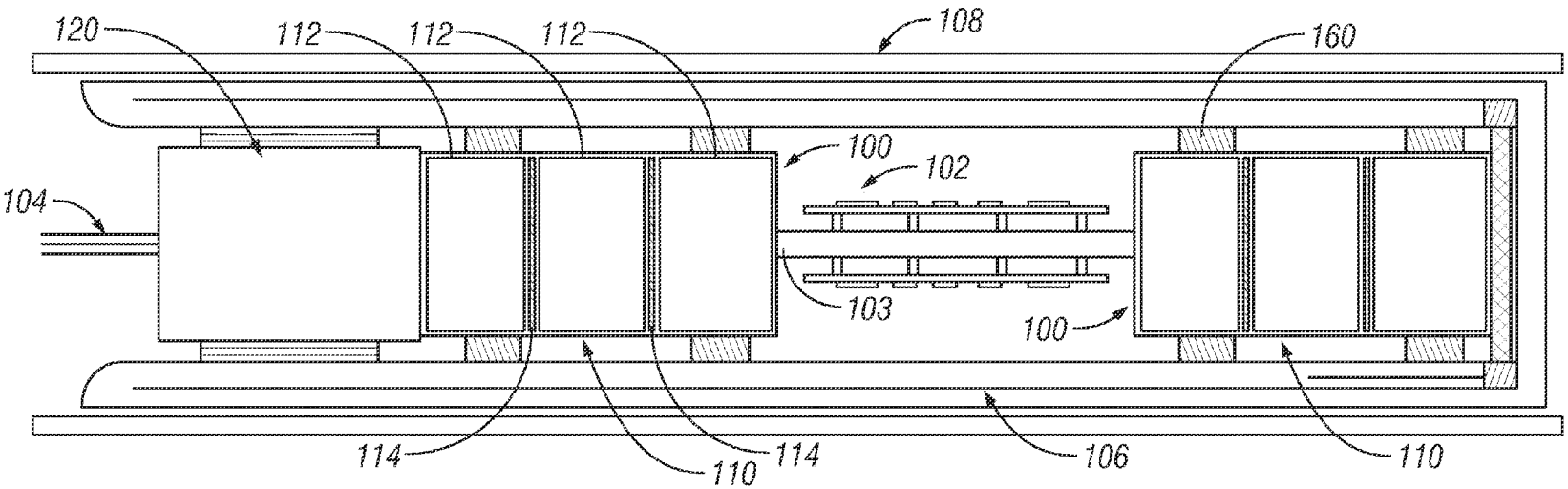
FIG. 1 schematically illustrates one embodiment of a thermal isolation device made in accordance with the present disclosure.

The present disclosure relates to devices and methods isolating heat sensitive components from a wellbore environment and/or heat generated by downhole components. The term "heat sensitive component" shall hereinafter be used to refer to any tool, electrical component, sensor, electronic instrument, structure, or material that degrades either in performance or in integrity when exposed to temperatures above 200 degrees centigrade. For purposes of discussion, a wellbore may be considered "hot" if the ambient temperature compromises or impairs the structural integrity, operating efficient, operating life, or reliability of a given tool, device, or instrument.

Aspects of the present disclosure may be utilized to increase temperature survival time of downhole tools and thereby increase the time heat sensitive equipment may be deployed in a wellbore. As will be appreciated, the present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. Further, while embodiments may be described has having one or more features or a combination of two or more features, such a feature or a combination of features should not be construed as essential unless expressly stated as essential.

Referring initially to FIG. 1, there is shown an exemplary thermal isolation device 100 for isolating an electronics package 102 from applied heat and/or generated heat. The electronics package 102 may include one or more heat sensitive components and may be mounted on and supported by a chassis 103. In one arrangement, the heat sensitive component 102 communicates with external devices via a cable 104. The components 102 may be positioned within a container 106 such as a Dewar-like vacuum flask and conveyed into a wellbore. In some embodiments, the container 106 may be directly inserted into a wellbore tool string. In other embodiments, the container may be positioned in a housing 108, which may be a sub, a module or other suitable structure. The container 106 provides a thermal barrier that isolates heat sensitive components from ambient wellbore temperatures. In some embodiments, the container 106 may employ a conventional double wall construction with an interstitial vacuum typical of Dewar flasks. However, the container 106 may be of any suitable configuration that prevents or reduces heat transfer from the downhole environment to the electronics package 102.

As will be discussed in greater detail below, the thermal isolation device 100 and the container 106 cooperate to provide passive cooling for the electronics package 102 by isolating the electronics package 102 from applied heat and/or self generated heat. The mechanisms for providing thermal isolation include providing a barrier to heat flow and absorbing heat.

In one embodiment, the thermal isolation device 100 includes one or more heat sinks 110 and a thermal isolator 120. The heat sinks 110 may be an object or mass configured to absorb and store thermal energy from internal heat-generating components and/or from the outside environment. Thus, the heat sinks 110 provide thermal isolation by diverting heat flow away from heat sensitive components. The heat sinks 110 may be solid elements or include cavities such as bores. In one embodiment, the heat sinks 110 are made from a eutectic phase changing material, such as bismuth alloys or lead with a high latent heat and low melting temperature. Eutectic materials change phase between their solid and liquid phases at the eutectic temperature (phase change temperature). The eutectic temperature stays substantially constant until the material completely changes the phase. In other embodiments, metals such as stainless steel may be used. As shown, a pair of heat sinks 110 may be utilized. In other embodiments, a single heat sink 110 may be used and in still other embodiments, three or more heat sinks 110 may be used. The heat sinks 110 may be configured to have the same thermal response or different thermal responses or absorb the same or different amounts of heat. For example, a first heat sink may be configured to have a stepped thermal response and a second heat sink may be configured to have a graduated (gradient) thermal response. Additionally, a first heat sink may be configured to absorb heat primarily from the electronics package 102 and a second heat sink may be configured to primarily absorb a heat applied by the wellbore environment. For instance, the heat sink 110 that is positioned proximate the thermal isolator 120 may be configured to absorb the heat applied by the wellbore environment whereas the heat sink 110 that is positioned distant from the thermal isolator 120 may be configured to absorb heat from the electronics package 102 and heat entering the interior of the container 106.

The thermal isolator 120 mechanically connects the internal components, such as heat sinks 110 and the electronics package 102, to the container 106. The chassis 103 may include a metallic plate to support a printed circuit board (PCB), electronics and sensors. The chassis 103 may also provide a medium to conduct heat from the electronics package 102 to the heat sinks 110 and therefore may be formed of a relatively high thermal conductivity material such as aluminum.

Figure 2:
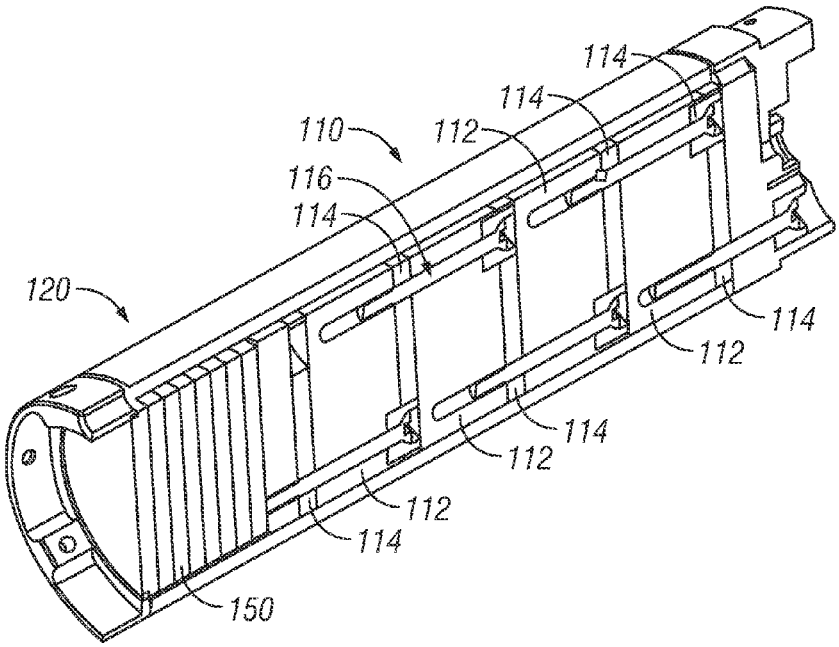
FIG. 2 isometrically illustrates in a sectional view one embodiment of a thermal isolation device made in accordance with the present disclosure.

Referring now to FIGS. 1 and 2, the heat sinks 110 may be configured to have a stepped thermal gradient to an applied heat. In one embodiment, the heat sinks 110 are formed of two or more masses 112 that are separated by spaces 114. In some embodiments, the spaces 114 include air or other gas. In other embodiments, the spaces 114 have a vacuum. In still other embodiments, the spaces 114 include a material having a low thermal conductivity. One such material is a nanoporous material. Nanoporous thermal insulating material is available from ASPEN AEROGELS and is commercially available under the trademark "PYROGEL". Nanoporous materials have an open cell structure that provide a relatively high proportion of free void volume (typically >90%) compared to conventional solid materials. Their high pore volume, low solid content, and torturous path amorphous structure give rise to lower values for thermal conductivity. Other suitable materials exhibiting low thermal conductivity include ceramics. In one sense, the structure of the heat sink 110 may be described as a segmented body having a plurality of elements formed of material that have high thermal energy absorption properties, each of the plurality of elements being separated by an element having low thermal conductivity.

Figure 3:
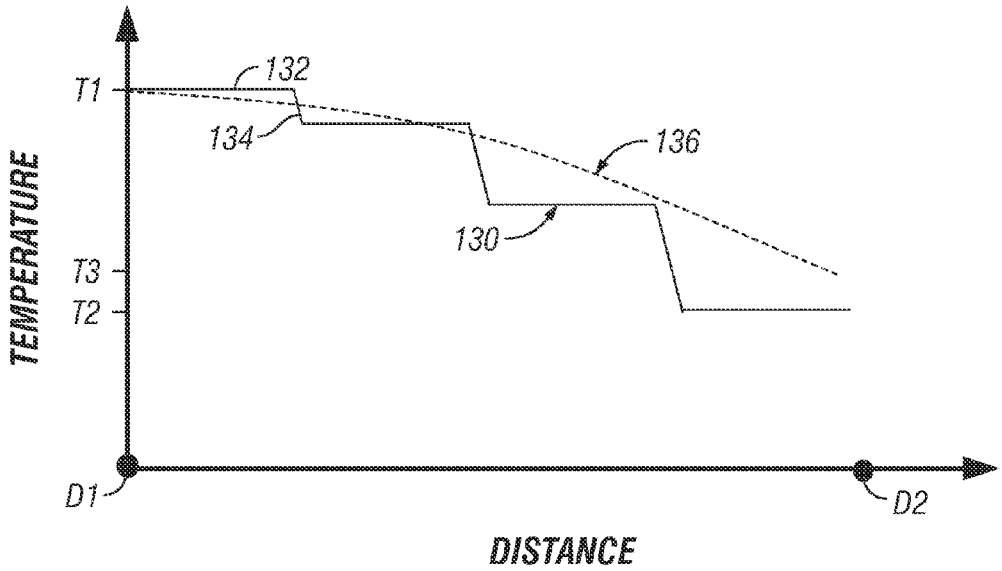
FIG. 3 graphically illustrates a thermal response of one embodiment of a heat sink made in accordance with the present disclosure.

FIG. 3 shows in graphical form an illustrative thermal response 130 of a FIG. 2 embodiment of the heat sink 110. Referring to FIGS. 2 and 3, the point D1 generally corresponds to the connection point between the heat sink 110 and the thermal isolator 120 and point D2 generally corresponds to the connection point between the heat sink 110 and the chassis 103. Thus, the "distance" is the axial distance along the long axis of the thermal isolation device 100. Axially along each of the masses 112, the temperature is substantially constant as shown by segments 132, only one of which has been labeled for clarity. However, each of the spaces 114 causes a relatively steep drop in temperature as shown by segments 134, only one of which has been labeled for clarity. For comparison, the graph includes an illustrative thermal response 136 of a conventional heat sink formed of one mass. As can be seen, for an applied temperature of T1, the conventional one mass heat sink applies a temperature T3 to the electronics package whereas the FIG. 2 heat sink 110 applies a lower temperature T2 to the electronics package. For instance, for an applied temperature T1 of 300 degrees Celsius, the temperature T3 may be 290 degrees Celsius whereas T2 may be 250 degrees Celsius. Of course, it should be understood that responses 130 and 132 are intended to be generalized depictions of thermal responses and variances in configuration, operating conditions, materials, and the like may influence the actual thermal response of a given heat sink. Moreover, the term "stepped" refers only to a response generally represented by alternating relatively flat segments and relatively sloped segments. No particular number of segments, magnitudes of temperature drops, gradients of temperature drops, or other such characteristics are necessarily encompassed in the term "stepped."

Referring now to FIG. 2, the heat sink 110 may include one or more features to enhance the stepped thermal response of the heat sink 110. In one arrangement, the masses 112 of the heat sink 110 are connected to one another using connectors 116 having low thermal conductivity. One illustrative connector is a stainless steel fastener that includes PEEK washers. Other connectors may include ceramic fasteners or fasteners made of low thermal conductivity material such as plastics. Additionally, each connector 116 may be configured to connect only two masses 112. Thus, each connector 116 forms a thermal path between only two masses 112. Additional thermal isolation and connection integrity may be provided by using materials such as ceramic inserts or washers at the connection points between the masses 112. These types of connectors or fasteners may also be used to connect the heat sink 110 to other components such as the thermal isolator 120.

Figure 4:
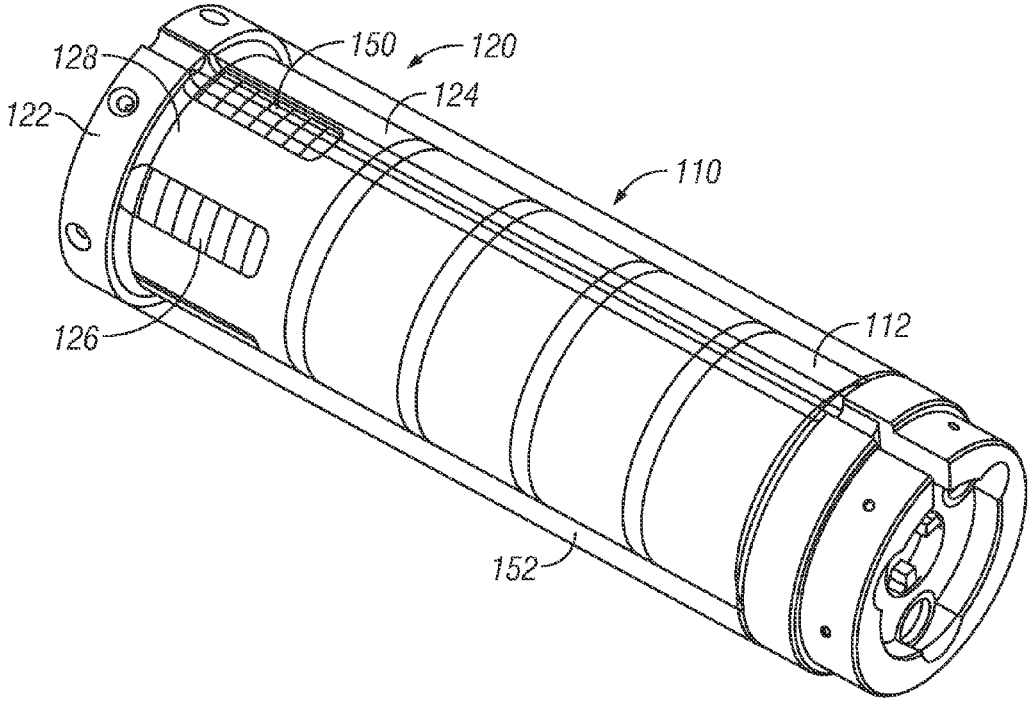
FIG. 4 isometrically illustrates one embodiment of a thermal isolation device made in accordance with the present disclosure.

Referring now to FIG. 4, there is schematically shown an illustrative thermal isolator 120. The thermal isolator 120 provides thermal isolation by impeding the flow of heat from the wellbore environment to the interior of the container 106. In one embodiment, the thermal isolator 120 may be formed as a tubular having a first end 122 that connects to the container 106 (FIG. 1) and a second end 124 that connects to the heat sink 110. In one embodiment, the thermal isolator 120 includes reduced cross-sectional areas formed by slots or openings 126. Thus, heat is transmitted from the first end 122 to the second end 124 substantially only across the bridges 128. Channeling heat energy through the bridges 128 may impede the transfer of heat between the first end 122 and the second end. In embodiments, the thermal isolator 120 may be at least partially formed of titanium or other material having low thermal conductivity. In embodiments, the thermal isolator 120 may be configured to resist deformation such as bending. In one arrangement, the slots 126 may be elongated longitudinally and arrayed to form a plurality of bridges 128. The longitudinally aligned bridges 128 form a structure that can resist bending of the thermal isolator 120.

Referring now to FIGS. 1 and 4, in embodiments, the thermal isolation device 100 strategically positions nanoporous material within the container 106 to reduce heat transfer to the electronics package 104. One exemplary location is inside the thermal isolator 120, wherein a volume of nanoporous material 150 reduces the heat applied to the adjacent mass 112. Another exemplary location is around the heat sinks 110 wherein a sleeve 152 of nanoporous material reduces heat transfer from the walls of the container 106 (FIG. 1) to the electronics package 102. Another exemplary location includes open spaces may otherwise be filled with air, which can be filled with a layer of nanoporous material.

Referring now to FIG. 1, other components may be utilized with the thermal isolation device 100 to thermally isolate the electronics package 102. To reduce movement of the electronics package 102, buffer elements 160 made of plastic or other suitable material may be used to prevent movement of the thermal isolation device 100 and the electronics package 102. The buffer elements 160 may be rings, spacers, shims or other suitable support devices.

Figure 5:
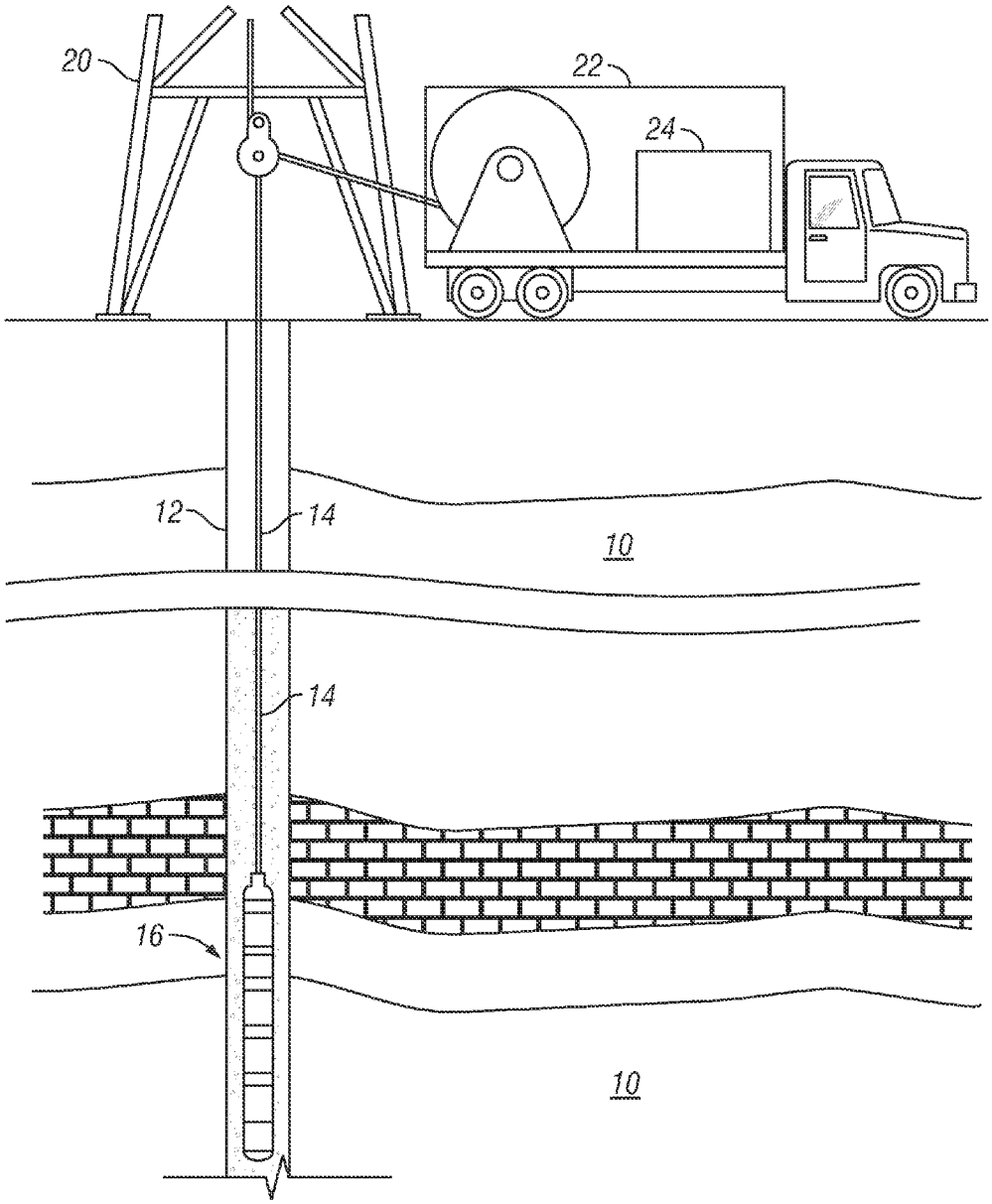
FIG. 5 is a schematic representation of a wireline tool utilizing the thermal isolation devices of the present disclosure.

Turning now to FIG. 5 a wireline deployment of wellbore instruments utilizing a thermal isolation device according to aspects of the present invention is depicted. While a land system is shown, the teachings of the present disclosure may also be utilized in offshore or subsea applications. FIG. 5 schematically shows a laminated earth formation 10 intersected by a well bore 12. A wireline 14 conveys an electronic logging tool 16 having sensors and electronics protected by one or more thermal isolation device into the well bore 12. The wireline 14 is suspended in the wellbore 12 from a rig 20. The wireline operation may be conducted by surface personnel using a suitable platform 22 that has equipment such as a controller 24 having processors, control devices, memory devices, etc. for operating and communicating with the logging tool 16. The equipment associated with wireline operations are known in the art and will not be discussed in further detail.

The logging tool 16 may include formation evaluation tools adapted to measure one or more parameters of interest relating to the formation or wellbore. It should be understood that the term formation evaluation tool encompasses measurement devices, sensors, and other like devices that, actively or passively, collect data about the various characteristics of the formation, directional sensors for providing information about the tool orientation and direction of movement, formation testing sensors for providing information about the characteristics of the reservoir fluid and for evaluating the reservoir conditions. The formation evaluation sensors may include resistivity sensors for determining the formation resistivity, dielectric constant and the presence or absence of hydrocarbons, acoustic sensors for determining the acoustic porosity of the formation and the bed boundary in formation, nuclear sensors for determining the formation density, nuclear porosity and certain rock characteristics, nuclear magnetic resonance sensors for determining the porosity and other petrophysical characteristics of the formation. The direction and position sensors preferably include a combination of one or more accelerometers and one or more gyroscopes or magnetometers. The accelerometers preferably provide measurements along three axes. The formation testing sensors collect formation fluid samples and determine the properties of the formation fluid, which include physical properties and chemical properties. Pressure measurements of the formation provide information about the reservoir characteristics.

The heat sensitive components associated with the logging tool are protected from the downhole environment using any of the thermal isolation devices previously described in connection with the electronics package 102 (FIG. 1). The wireline 14 may be operably coupled to the electronics package 102 (FIG. 1) via the cable 104 (FIG. 1). The logging tool 16 may be in the wellbore 12 for eight hours or longer. During this time, the tool 16 may be subjected to temperatures in excess of 200 degrees Celsius.

Referring now to FIGS. 1-4, the electronics 102 is initially protected from the high wellbore temperatures by the container 106, which functions as a heat shield or barrier. Heat flow from the thermal isolator 120 end of the container 106 to the container interior is impeded in at least two ways. First, in embodiments where the thermal isolator 120 is formed of titanium or other material having low thermal conductivity, the material of the thermal isolator 120 itself impedes heat transfer. Second, the slots 126 formed in the thermal isolator 104 reduces the available cross-sectional area for heat transfer across the thermal isolator 120. Additionally, the volume of nanoporous material 150 inside the thermal isolator 120 provides a thermal barrier between the outside environment and the heat sink 110. Thus, the thermal isolator 120 and the volume of nanoporous material 150, if present, provide the first barrier that thermally decouples the electronics 102 from the wellbore environment. Thereafter, additional thermal protection is provided by the heat sinks 110. For instance, heat that is transmitted across the thermal isolator 120 is absorbed within the thermally decoupled masses 112 making up the heat sink 110. The spacings 114 cause each of the separate masses 112 to in succession or in a step-wise fashion reach a given temperature before transferring a substantial amount of heat to an adjacent mass 112. Additionally, the heat sinks 110 may also absorb heat generated by the electronics package 102. For example, the heat conductive chassis 103 may convey generated heat from the electronics package 102 to the heat sinks 110. As noted previously, the thermal isolation device 100 may include one heat sink 110 or more than one heat sink 110 and each heat sink 110 may be configured to absorb different amounts of heat and absorb heat from different sources.

While a wireline conveyance device has been illustrated, it should be understood that other conveyance devices such as slicklines may also be utilized in certain applications. As is known, wirelines are generally configured to transmit data and/or power between the surface and the downhole tool 16 whereas slicklines are not configured for data and/or power transfer. Aspects of the present invention may also be utilized with rigid conveyance devices, such as coiled tubing and jointed drill pipe, as well as non-rigid conveyance devices such as wirelines and slicklines.

Figure 6:
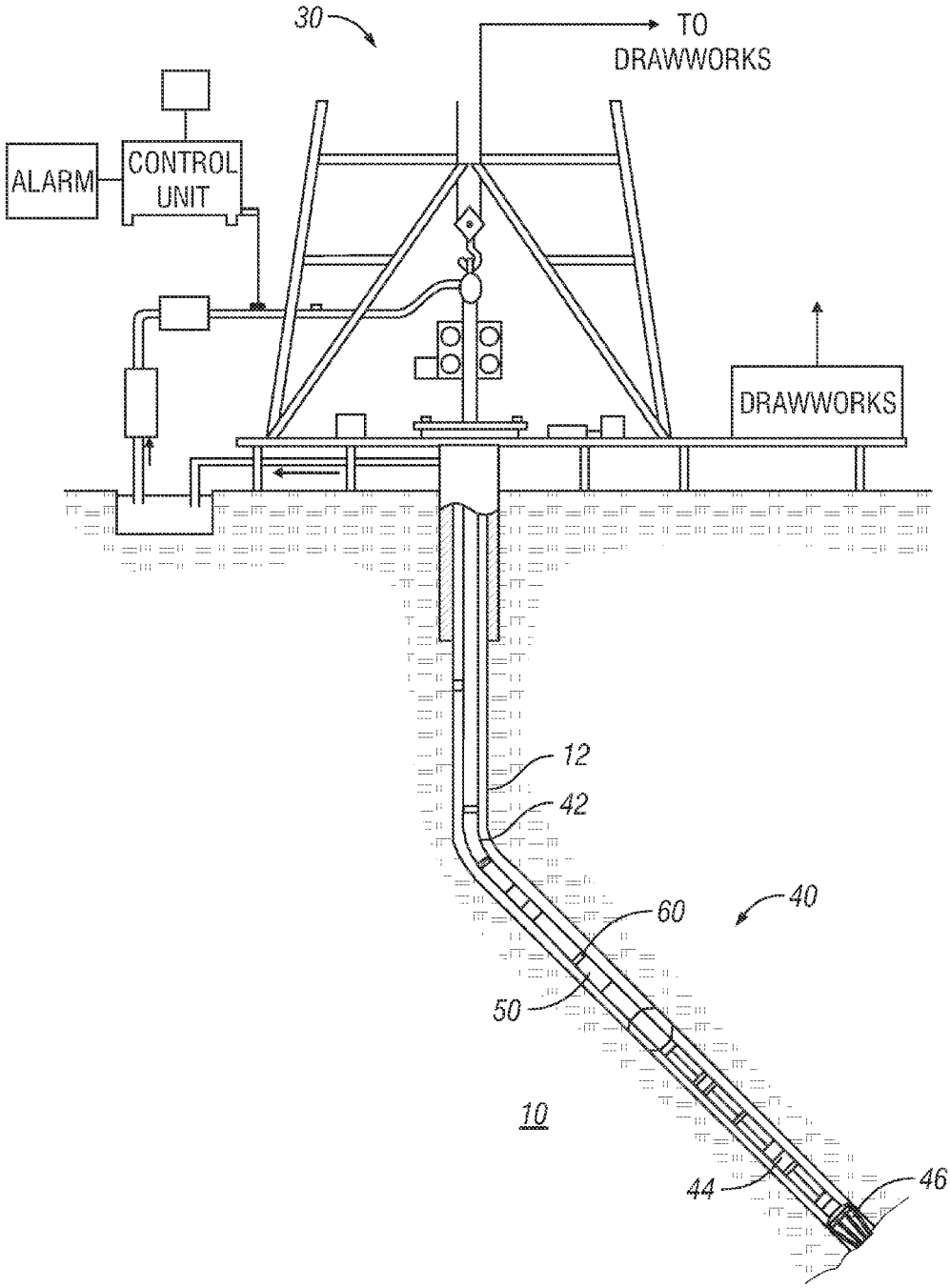
FIG. 6 is a schematic representation of a drilling system utilizing the thermal isolation devices of the present disclosure.

Referring now to FIG. 6, there is shown a schematic diagram of a drilling system 30 having a bottom hole assembly (BHA) or drilling assembly 40 conveyed via a tubing 42 into the wellbore 12 formed in the formation 10. The tubing 42 may be jointed drill pipe or coiled tubing, which may include embedded conductors for power and/or data for providing signal and/or power communication between the surface and downhole equipment. The BHA 40 may include a drilling motor 44 for rotating a drill bit 46. Other devices that may be included but not shown along the BHA 40 is a steering assembly for steering the drill bit 46 in a selected direction, one or more BHA processors, one or more stabilizers, and other equipment known to those skilled in the art. The drill bit 46 may be rotated in any one of three modes: rotation by only the tubing 42, rotation by only the drilling motor 44, and rotation by a combined use of the tubing 42, and drilling motor 44. The BHA 40 also includes a logging tool 50, which may include a suite of tool modules, that obtain information relating to the geological, geophysical and/or petrophysical characteristics of the formation 10 being drilled.

The BHA 40 as well as the logging tool 50 may include heat sensitive components. Such components include those that incorporate transistors, integrated circuits, resistors, capacitors, and inductors, as well as electronic components such as sensing elements, including accelerometers, magnetometers, photomultiplier tubes, and strain gages. The thermal isolation systems provided by the present disclosure, such as those shown in the Figures, may be utilized to protect these components from the hot wellbore environment. The BHA 40 may also include communication devices, transmitters, repeaters, processors, power generation devices, or other devices that may incorporate heat sensitive components. In many applications, the drilling system 30 may be operated for well over eight hours downhole. Given the extended time that the BHA 40 and logging tool 50 may be exposed to the downhole environment, a strictly passive thermal isolation system may not be sufficient to fully protect heat sensitive components from the heat applied by the downhole environment and/or the heat generated by devices such as electrical components. Thus, in embodiments, in conjunction with the thermal isolation systems previously described, an active cooling system 60 may be utilized to cool heat sensitive components. In one arrangement, heat sensitive electronic components are juxtaposed with one or more refrigeration devices such as sorbent coolers. The active cooling system 60 may be a powered device selected from a group consisting of a: (i) Peltier cooler; (ii) closed-loop cooling unit; and (iii) heat pump that employs one of: (a) Joule-Thompson effect and (b) Stirling Engine. Of course, active cooling may also be utilized with heat sensitive components conveyed by non-rigid conveyance devices.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. An apparatus for isolating a heat sensitive component deployed in a downhole environment, comprising:

a heat sink positioned adjacent to the heat sensitive component, the heat sink having a stepped thermal response to an applied heat, wherein the heat sink includes at least two masses, the at least two masses being substantially thermally decoupled.

2. The apparatus of claim 1, further comprising a nanoporous material positioned between the at least two masses.

3. The apparatus of claim 1, further comprising a container having an interior receiving the heat sensitive component and the heat sink, the container being configured to be deployed into a wellbore with a conveyance device.

4. The apparatus of claim 3, further comprising a connector connecting the heat sink to the container.

5. The apparatus of claim 4 wherein the connector includes at least one bridge portion having a reduced cross-sectional area, the at least one bridge portion conveying an applied heat from a first end of the connector to a second end of the connector.

6. The apparatus of claim 4 wherein the connector includes at least one elongated opening aligned along a longitudinal axis of the connector.

7. The apparatus of claim 1, further comprising a nanonporous material thermally isolating the heat sink from a heat applied by the downhole environment.

8. A method for isolating a heat sensitive component deployed in a downhole environment, comprising:

positioning a heat sink adjacent to the heat sensitive component, the heat sink having a stepped thermal response to an applied heat, wherein the heat sink includes at least two masses; and substantially thermally decoupling the at least two masses.

9. The method of claim 8, further comprising positioning a nanoporous material between the at least two masses.

10. The method of claim 8, further comprising positioning the heat sensitive component and the heat sink inside a container having a thermal barrier.

11. The method of claim 10, further comprising connecting the heat sink to the container with a connector.

12. The method of claim 11, further comprising forming along the connector one of: (i) a slot, and (ii) a bridge portion.

13. The method of claim 8, further comprising thermally isolating the heat sink from a heat applied by the downhole environment with a nanoporous material.

14. A system for performing an operation in a wellbore formed in a subterranean formation, comprising:

a conveyance device configured to be deployed into the wellbore;

a container coupled to the conveyance device, the container including at least one thermal barrier and having an interior space;

at least one heat sensitive component positioned in the interior space; and a heat sink positioned adjacent to the heat sensitive component, the heat sink having a stepped thermal response to an applied heat, wherein the heat sink includes at least two masses, the at least two masses being substantially thermally decoupled.

15. The system of claim 14 further comprising a nanoporous material positioned between the at least two masses.

16. The system of claim 14, further comprising a connector connecting the heat sink to the container, the connector having one of: (i) at least one bridge portion, and (ii) at least one elongated opening aligned along a longitudinal axis of the connector.

17. The system of claim 14, further comprising a nanoporous material thermally isolating the heat sink from a heat applied by the downhole environment.

18. The system of claim 14, wherein the conveyance device is one of: (i) a wireline, (ii) a slickline, (iii) a coiled tubing, and (iv) drill pipe.

* * * * *